US009093745B2

(12) United States Patent
Yarga et al.

(10) Patent No.: US 9,093,745 B2
(45) Date of Patent: Jul. 28, 2015

(54) ANTENNA AND PROXIMITY SENSOR STRUCTURES HAVING PRINTED CIRCUIT AND DIELECTRIC CARRIER LAYERS

(75) Inventors: Salih Yarga, Sunnyvale, CA (US); Nirali Shah, Mountain View, CA (US); Qingxiang Li, Mountain View, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 352 days.

(21) Appl. No.: 13/468,289

(22) Filed: May 10, 2012

(65) Prior Publication Data

US 2013/0300618 A1 Nov. 14, 2013

(51) Int. Cl.

| | |
|---|---|
| ***H01Q 1/24*** | (2006.01) |
| ***H01Q 1/38*** | (2006.01) |
| ***H01Q 1/44*** | (2006.01) |

(52) U.S. Cl.

CPC ..... *H01Q 1/243* (2013.01); *H01Q 1/245* (2013.01); *H01Q 1/38* (2013.01); *H01Q 1/44* (2013.01)

(58) Field of Classification Search

CPC ..... H01Q 1/243; H01Q 1/42; H01Q 1/44; H01Q 1/38

USPC ..... 343/702, 720

See application file for complete search history.

(56) References Cited

U.S. PATENT DOCUMENTS

| | | | |
|---|---|---|---|
| 4,546,357 | A | 10/1985 | Laughon et al. |
| 5,337,353 | A | 8/1994 | Boie et al. |
| 5,338,353 | A | 8/1994 | Uchino et al. |
| 5,463,406 | A | 10/1995 | Vannatte et al. |
| 5,650,597 | A | 7/1997 | Redmayne |

(Continued)

FOREIGN PATENT DOCUMENTS

| | | |
|---|---|---|
| CN | 101048914 | 10/2007 |
| CN | 101459273 | 6/2009 |

(Continued)

OTHER PUBLICATIONS

Myllymaki et al., "Capacitive Recognition of the User's Hand Grip Position in Mobile Handsets", Progress in Electromagnetics Research B, Electromagnetics Academy, US; The Institution of Electrical Engineers, Stevenage, GB, vol. 22, Jan. 1, 2010, pp. 203-220.

(Continued)

*Primary Examiner* — Robert Karacsony

(74) *Attorney, Agent, or Firm* — Treyz Law Group; G. Victor Treyz; Joseph F. Guihan

(57) ABSTRACT

An electronic device may have a conductive housing with an antenna window. A display cover layer may be mounted on the front face of the device. Antenna and proximity sensor structures may include a dielectric support structure with a notch. The antenna window may have a protruding portion that extends into the notch between the display cover layer and the antenna and proximity sensor structures. The antenna and proximity sensor structures may have an antenna feed that is coupled to a first conductive layer by a high pass circuit and capacitive proximity sensor circuitry that is coupled to the first conductive layer and a parallel second conductive layer by a low pass circuit. The first conductive layer may be formed from a metal coating on the support structure. The second conductive layer may be formed from patterned metal traces in a flexible printed circuit.

12 Claims, 12 Drawing Sheets

(56) References Cited

U.S. PATENT DOCUMENTS

| | | | |
|---|---|---|---|
| 5,826,458 | A | 10/1998 | Little |
| 5,854,972 | A | 12/1998 | Pennock et al. |
| 5,864,316 | A | 1/1999 | Bradley et al. |
| 5,905,467 | A | 5/1999 | Narayanaswamy et al. |
| 5,917,450 | A | 6/1999 | Tsunekawa et al. |
| 5,956,626 | A | 9/1999 | Kashke et al. |
| 6,124,831 | A | 9/2000 | Rutkowski et al. |
| 6,329,958 | B1 | 12/2001 | McLean et al. |
| 6,380,899 | B1 | 4/2002 | Madsen et al. |
| 6,384,681 | B1 | 5/2002 | Bonds |
| 6,408,193 | B1 | 6/2002 | Katagishi et al. |
| 6,456,250 | B1 | 9/2002 | Ying et al. |
| 6,456,856 | B1 | 9/2002 | Werting et al. |
| 6,529,088 | B2 | 3/2003 | Lafleur et al. |
| 6,590,539 | B2 | 7/2003 | Shinchi |
| 6,611,227 | B1 | 8/2003 | Nebiyetoul-Kifle et al. |
| 6,657,595 | B1 | 12/2003 | Phillips et al. |
| 6,664,931 | B1 | 12/2003 | Nguyen et al. |
| 6,678,532 | B1 | 1/2004 | Mizoguchi |
| 6,822,611 | B1 | 11/2004 | Kontogeorgakis et al. |
| 6,879,293 | B2 | 4/2005 | Sato |
| 6,903,686 | B2 | 6/2005 | Vance et al. |
| 6,937,192 | B2 | 8/2005 | Mendolia et al. |
| 6,978,121 | B1 | 12/2005 | Lane et al. |
| 6,985,113 | B2 | 1/2006 | Nishimura et al. |
| 7,016,686 | B2 | 3/2006 | Spaling |
| 7,016,705 | B2 | 3/2006 | Bahl et al. |
| 7,039,435 | B2 | 5/2006 | McDowell et al. |
| 7,050,010 | B2 | 5/2006 | Wang et al. |
| 7,053,629 | B2 | 5/2006 | Nevermann |
| 7,064,721 | B2 | 6/2006 | Zafar et al. |
| 7,109,945 | B2 | 9/2006 | Mori |
| 7,113,087 | B1 | 9/2006 | Casebolt |
| 7,146,139 | B2 | 12/2006 | Nevermann |
| 7,321,336 | B2 | 1/2008 | Phillips et al. |
| 7,383,067 | B2 | 6/2008 | Phillips et al. |
| 7,499,722 | B2 | 3/2009 | McDowell et al. |
| 7,522,846 | B1 | 4/2009 | Lewis et al. |
| 7,557,760 | B2 | 7/2009 | Chang et al. |
| 7,595,759 | B2 | 9/2009 | Schtub et al. |
| 7,633,076 | B2 | 12/2009 | Huppi et al. |
| 7,653,883 | B2 | 1/2010 | Hotelling et al. |
| 7,826,875 | B2 | 11/2010 | Karaoguz et al. |
| 7,864,123 | B2 | 1/2011 | Hill et al. |
| 7,876,274 | B2 | 1/2011 | Hobson et al. |
| 7,896,196 | B2 | 3/2011 | Wegelin et al. |
| 7,916,089 | B2 | 3/2011 | Schtub et al. |
| 7,999,748 | B2 | 8/2011 | Ligtenberg et al. |
| 8,159,399 | B2 | 4/2012 | Dorsey et al. |
| 8,255,009 | B2 | 8/2012 | Sorensen et al. |
| 8,289,248 | B2 | 10/2012 | Kunkel |
| 8,301,094 | B2 | 10/2012 | Ahn et al. |
| 8,325,094 | B2 | 12/2012 | Vazquez et al. |
| 8,326,221 | B2 | 12/2012 | Dorsey et al. |
| 8,432,322 | B2 | 4/2013 | Amm et al. |
| 2002/0094789 | A1 | 7/2002 | Harano |
| 2002/0123309 | A1 | 9/2002 | Collier et al. |
| 2003/0186728 | A1 | 10/2003 | Manjo |
| 2003/0210203 | A1 | 11/2003 | Phillips et al. |
| 2003/0218993 | A1 | 11/2003 | Moon et al. |
| 2004/0116157 | A1 | 6/2004 | Vance et al. |
| 2004/0176083 | A1 | 9/2004 | Shiao et al. |
| 2004/0263403 | A1 | 12/2004 | Zafar et al. |
| 2005/0245204 | A1 | 11/2005 | Vance |
| 2006/0232468 | A1 | 10/2006 | Parker et al. |
| 2006/0244663 | A1 | 11/2006 | Fleck et al. |
| 2007/0109204 | A1 | 5/2007 | Phillips et al. |
| 2007/0188375 | A1 | 8/2007 | Richards et al. |
| 2007/0238496 | A1 | 10/2007 | Chung et al. |
| 2008/0012774 | A1 | 1/2008 | Wang |
| 2008/0067715 | A1 | 3/2008 | Sung |
| 2008/0316120 | A1 | 12/2008 | Hirota et al. |
| 2008/0316121 | A1 | 12/2008 | Hobson et al. |
| 2009/0051611 | A1 | 2/2009 | Shamblin et al. |
| 2009/0058735 | A1 | 3/2009 | Hill et al. |
| 2009/0096683 | A1 | 4/2009 | Rosenblatt et al. |
| 2009/0174611 | A1 | 7/2009 | Schlub et al. |
| 2009/0305742 | A1 | 12/2009 | Caballero et al. |
| 2009/0322636 | A1 | 12/2009 | Brigham et al. |
| 2010/0127938 | A1 | 5/2010 | Ali et al. |
| 2010/0156790 | A1 | 6/2010 | Su et al. |
| 2010/0321253 | A1 | 12/2010 | Ayala Vazquez et al. |
| 2011/0012790 | A1 | 1/2011 | Badaruzzaman et al. |
| 2011/0012793 | A1 | 1/2011 | Amm et al. |
| 2011/0012794 | A1 | 1/2011 | Schlub et al. |
| 2011/0043227 | A1 | 2/2011 | Pance et al. |
| 2011/0134014 | A1 | 6/2011 | Kondo et al. |
| 2011/0250928 | A1 | 10/2011 | Schlub et al. |
| 2012/0214412 | A1* | 8/2012 | Schlub et al. ..... 455/41.1 |
| 2013/0076573 | A1* | 3/2013 | Rappoport et al. ..... 343/702 |

FOREIGN PATENT DOCUMENTS

| | | |
|---|---|---|
| CN | 101958454 | 1/2011 |
| CN | 101958455 | 1/2011 |
| CN | 101958460 | 1/2011 |
| DE | 102005035935 | 2/2007 |
| EP | 0564164 | 10/1993 |
| EP | 1298809 | 4/2003 |
| EP | 1469550 | 10/2004 |
| EP | 1524774 | 4/2005 |
| EP | 1564896 | 8/2005 |
| EP | 2065971 | 6/2009 |
| EP | 2276109 | 1/2011 |
| GB | 2380359 | 4/2003 |
| JP | 2001148603 | 5/2001 |
| JP | 2003179670 | 6/2003 |
| JP | 2003209483 | 7/2003 |
| JP | 2006217026 | 8/2006 |
| JP | 2008-72721 | 3/2008 |
| JP | 2008193299 | 8/2008 |
| JP | 2009032570 | 2/2009 |
| JP | 2010531574 | 9/2010 |
| KR | 10-2012-0035937 | 4/2012 |
| KR | 10-2012-0044999 | 5/2012 |
| WO | 0131733 | 5/2001 |
| WO | 0205443 | 1/2002 |
| WO | 0231912 | 4/2002 |
| WO | 02078123 | 10/2002 |
| WO | 2005112280 | 11/2005 |
| WO | 2007036610 | 4/2007 |
| WO | 2007116790 | 10/2007 |
| WO | 2008078142 | 7/2008 |
| WO | 2009002575 | 12/2008 |
| WO | 2009022387 | 2/2009 |
| WO | 2009149023 | 12/2009 |
| WO | 2010123733 | 10/2010 |
| WO | 2011005518 | 1/2011 |
| WO | 2011013438 | 2/2011 |
| WO | 2011018551 | 2/2011 |

OTHER PUBLICATIONS

Schlub et al. U.S. Appl. No. 12/632,697, filed Dec. 7, 2009.
Amm et al. U.S. Appl. No. 12/632,695, filed Dec. 7, 2009.
Shiu et al. U.S. Appl. No. 13/220,230, filed Aug. 29, 2011.
Schlub et al. U.S. Appl. No. 13/029,581, filed Feb. 17, 2011.
Ayala Vazquez et al. U.S. Appl. No. 13/038,300, filed Mar. 1, 2011.
Li et al. U.S. Appl. No. 13/038,169, filed Mar. 1, 2011.
Schlub et al. U.S. Patent Application filed Feb. 17, 2011.
Shiu et al. U.S. Patent Application filed Sep. 30, 2011.
"CapTouch Programmable Controller for Single-Electrode Capacitance Sensors", AD7147 Data Sheet Rev. B, [online], Analog Devices, Inc., [retrieved on Dec. 7, 2009]. <URL: http://www.analog.com/static/imported-files/data_sheets/AD7 1 47.pdf>.

* cited by examiner

ANTENNA AND PROXIMITY SENSOR STRUCTURES HAVING PRINTED CIRCUIT AND DIELECTRIC CARRIER LAYERS

BACKGROUND

This relates generally to electronic devices, and, more particularly, to antennas in electronic devices.

Electronic devices such as portable computers and handheld electronic devices are becoming increasingly popular. Devices such as these are often provided with wireless communications capabilities. For example, electronic devices may use long-range wireless communications circuitry to communicate using cellular telephone bands. Electronic devices may use short-range wireless communications links to handle communications with nearby equipment. Electronic devices are also often provided with sensors and other electronic components.

It can be difficult to incorporate antennas, sensors, and other electrical components successfully into an electronic device. Some electronic devices are manufactured with small form factors, so space for components is limited. In many electronic devices, the presence of conductive structures can influence the performance of electronic components, further restricting potential mounting arrangements for components such as wireless communications devices and sensors.

It would therefore be desirable to be able to provide improved ways in which to incorporate components in electronic devices.

SUMMARY

An electronic device may have a housing in which antenna and proximity sensor structures may be mounted. The housing may be a conductive housing with an antenna window. The antenna and proximity sensor structures may be mounted behind the antenna window. During operation, antenna signals and electromagnetic proximity sensor signals may pass through the antenna window.

A display cover layer such as a planar glass member may be mounted on the front face of the device. The antenna and proximity sensor structures may include a dielectric support structure with recessed features such as a notch. The antenna window may have a protruding portion that extends into the notch between the display cover layer and the antenna and proximity sensor structures. The display cover layer may be mounted over the protruding portion. A layer of opaque material on the underside of the display cover layer over the protruding portion may hide the antenna and proximity sensor structures and other internal device structures from view from the exterior of the device.

The antenna and proximity sensor structures may include parallel first and second conductive layers on the dielectric support structure. The antenna and proximity sensor structures may have an antenna feed that is coupled to the first conductive layer by a high pass circuit. The feed may have first and second terminals. The first terminal may be coupled to the first conductive layer by a first capacitor and the second terminal may be coupled to the first conductive layer by a second capacitor.

Capacitive proximity sensor circuitry in the electronic device may be coupled to the first and second conductive layers by a low pass circuit. The capacitive proximity sensor circuitry may, for example, be coupled to the first conductive layer by a first inductor and the second conductive layer by a second inductor.

The first conductive layer may be formed from a metal coating on the support structure. The second conductive layer may be formed from patterned metal traces in a printed circuit.

Further features of the invention, its nature and various advantages will be more apparent from the accompanying drawings and the following detailed description of the preferred embodiments.

DETAILED DESCRIPTION

Electronic devices may be provided with antennas, sensors, and other electronic components. It may be desirable to form some of these components from flexible structures. For example, it may be desirable to form components for electronic devices using flexible printed circuit structures. Flexible printed circuits, which are sometimes referred to as flex circuits, may include patterned metal traces on flexible substrates such as layers of polyimide or other flexible polymer sheets. Flex circuits may be used in forming antennas, capacitive sensors, assemblies that include antenna and capacitive sensor structures, other electronic device components, or combinations of these structures.

In some situations, it may be desirable to form conductive electronic component structures that have bends and other potentially complex shapes. For example, antennas, sensors, and other electronic components may include one or more bends to facilitate mounting within an electronic device housing. To ensure that electronic components such as antenna and sensor structures can be mounted within this type of device housing, electronic components such as antenna and sensor structures may be formed using patterned metal layers on flexible printed circuits and patterned metal coatings formed on dielectric carrier structures such as molded plastic structures.

Figure 1:
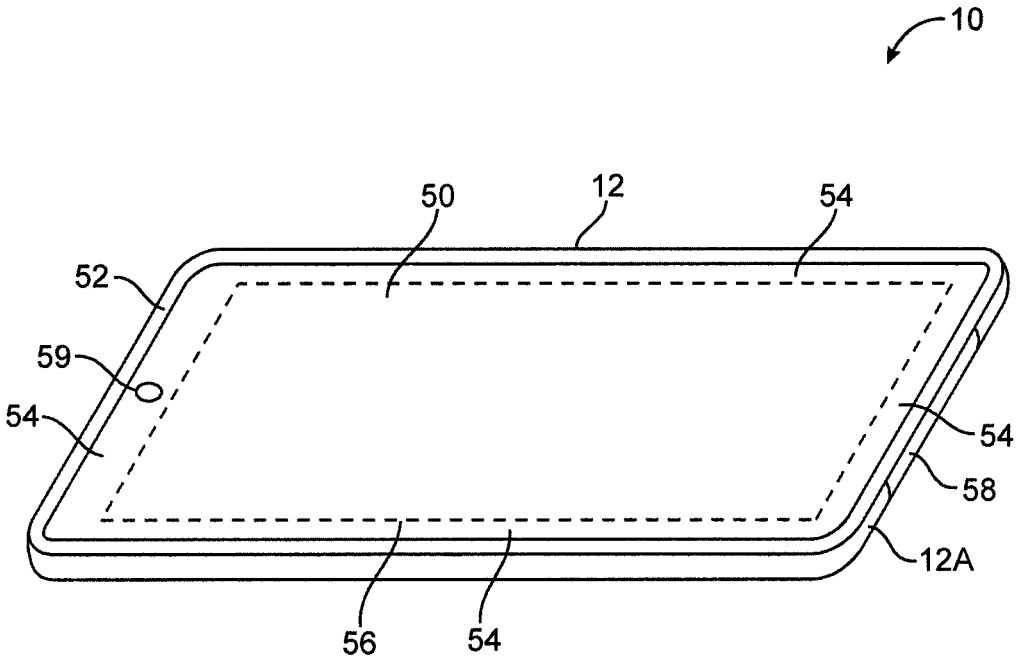
FIG. 1 is a front perspective view of an illustrative electronic device of the type that may be provided with component structures in accordance with an embodiment of the present invention.

An illustrative electronic device in which electronic components may be used is shown in FIG. 1. Device 10 may include one or more antenna resonating elements, one or more capacitive proximity sensor structures, one or more components that include antenna structures and proximity sensor structures, and other electronic components. Illustrative arrangements in which an electronic device such as device 10 of FIG. 1 is provided with electronic components such as antenna structures and/or proximity sensor structures that are formed from multiple conductive layers are sometimes described herein as an example. In general, electronic devices may be provided with any suitable electronic components that include multiple conductive layers. The electronic devices may be, for example, desktop computers, computers integrated into computer monitors, portable computers, tablet computers, handheld devices, cellular telephones, wristwatch devices, pendant devices, other small or miniature devices, televisions, set-top boxes, or other electronic equipment.

As shown in FIG. 1, device 10 may have a display such as display 50. Display 50 may be mounted on a front (top) surface of device 10 or may be mounted elsewhere in device 10. Device 10 may have a housing such as housing 12. Housing 12 may have curved portions that form the edges of device 10 and a relatively planar portion that forms the rear surface of device 10 (as an example). Housing 12 may also have other shapes, if desired.

Housing 12 may be formed from conductive materials such as metal (e.g., aluminum, stainless steel, etc.), carbon-fiber composite material or other fiber-based composites, glass, ceramic, plastic, or other materials. A radio-frequency (RF) window (sometimes referred to as an antenna window) such as RF window 58 may be formed in housing 12 (e.g., in a configuration in which the rest of housing 12 is formed from conductive structures). Window 58 may be formed from plastic, glass, ceramic, or other dielectric material. Antenna and proximity sensor structures for device 10 may be formed in the vicinity of window 58 or may be covered with dielectric portions of housing 12.

Device 10 may have user input-output devices such as button 59. Display 50 may be a touch screen display that is used in gathering user touch input. The surface of display 50 may be covered using a dielectric member such as a planar cover glass member or a clear layer of plastic. The central portion of display 50 (shown as region 56 in FIG. 1) may be an active region that displays images and that is sensitive to touch input. The peripheral portion of display 50 such as region 54 may be an inactive region that is free from touch sensor electrodes and that does not display images.

A layer of material such as opaque ink or plastic may be placed on the underside of display 50 in peripheral region 54 (e.g., on the underside of the cover glass). This layer may be transparent to radio-frequency signals. The conductive touch sensor electrodes in region 56 may tend to block radio-frequency signals. However, radio-frequency signals may pass through the cover glass and the opaque layer in inactive display region 54 (as an example). Radio-frequency signals may also pass through antenna window 58 or dielectric housing walls in housing formed from dielectric material. Lower-frequency electromagnetic fields may also pass through window 58 or other dielectric housing structures, so capacitance measurements for a proximity sensor may be made through antenna window 58 or other dielectric housing structures.

With one suitable arrangement, housing 12 may be formed from a metal such as aluminum. Portions of housing 12 in the vicinity of antenna window 58 may be used as antenna ground. Antenna window 58 may be formed from a dielectric material such as polycarbonate (PC), acrylonitrile butadiene styrene (ABS), a PC/ABS blend, or other plastics (as examples). Window 58 may be attached to housing 12 using adhesive, fasteners, or other suitable attachment mechanisms. To ensure that device 10 has an attractive appearance, it may be desirable to form window 58 so that the exterior surfaces of window 58 conform to the edge profile exhibited by housing 12 in other portions of device 10. For example, if housing 12 has straight edges 12A and a flat bottom surface, window 58 may be formed with a right-angle bend and vertical sidewalls. If housing 12 has curved edges 12A, window 58 may have a similarly curved exterior surface along the edge of device 10.

Figure 2:
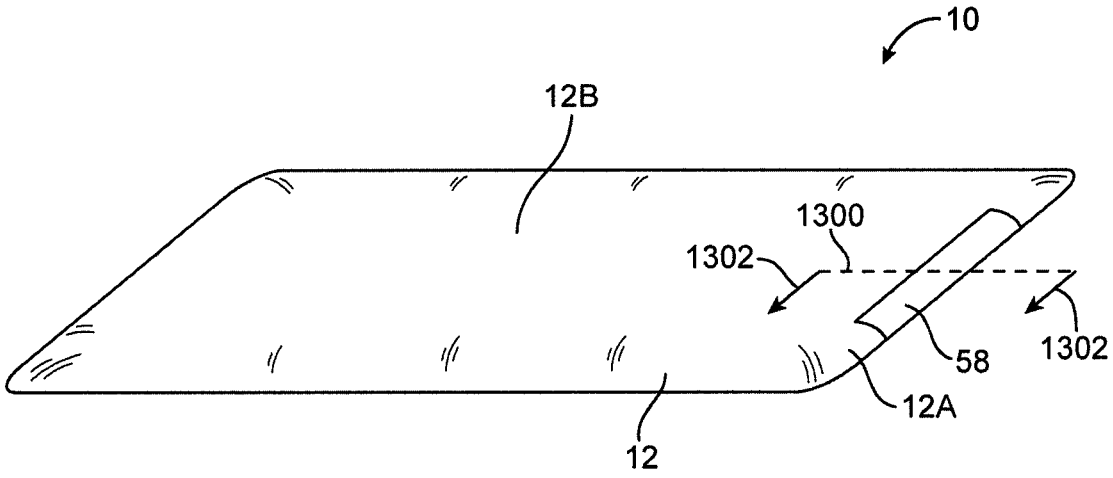
FIG. 2 is a rear perspective view of an illustrative electronic device such as the electronic device of FIG. 1 in accordance with an embodiment of the present invention.

FIG. 2 is a rear perspective view of device 10 of FIG. 1 showing how device 10 may have a relatively planar rear surface 12B and showing how antenna window 58 may be rectangular in shape with curved portions that match the shape of curved housing edges 12A.

Figure 3:
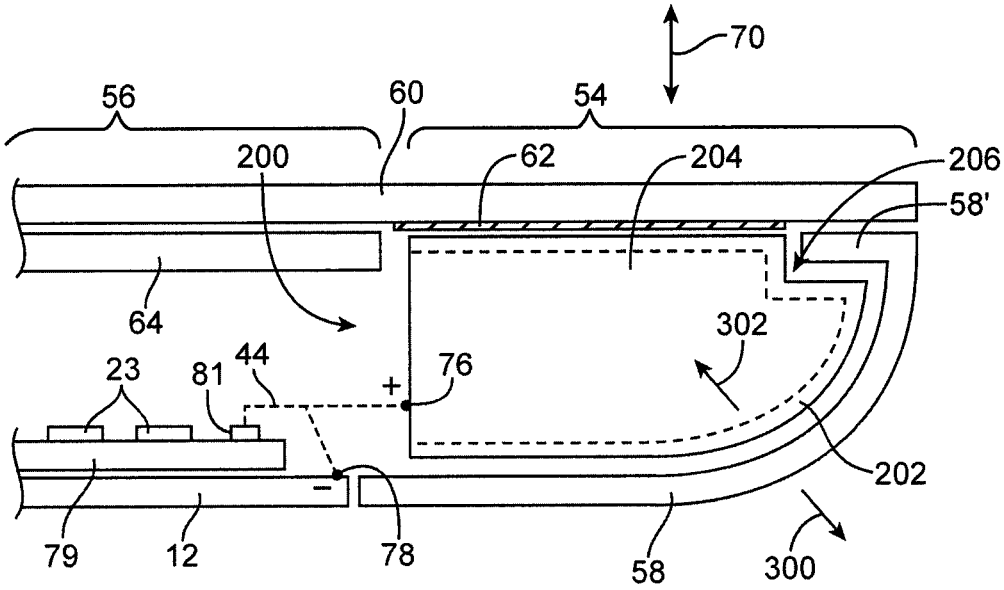
FIG. 3 is a cross-sectional side view of a portion of the electronic device of FIGS. 1 and 2 in accordance with an embodiment of the present invention.

A cross-sectional view of device 10 taken along line 1300 of FIG. 2 and viewed in direction 1302 is shown in FIG. 3. As shown in FIG. 3, antenna and proximity sensor structures 200 may be mounted within device 10 in the vicinity of RF window (antenna window) 58. Structures 200 may include conductive material that serves as an antenna resonating element for an antenna. The antenna may be fed using transmission line 44. Transmission line 44 may have a positive signal conductor that is coupled to positive antenna feed terminal 76 and a ground signal conductor that is coupled to antenna ground (e.g., housing 12 and other conductive structures) at ground antenna feed terminal 78.

The antenna resonating element formed from structures 200 may be based on any suitable antenna resonating element design (e.g., structures 200 may form a patch antenna resonating element, a single arm inverted-F antenna structure, a dual-arm inverted-F antenna structure, other suitable multi-arm or single arm inverted-F antenna structures, a closed and/or open slot antenna structure, a loop antenna structure, a monopole, a dipole, a planar inverted-F antenna structure, a hybrid of any two or more of these designs, etc.). Housing 12 may serve as antenna ground for an antenna formed from structure 200 and/or other conductive structures within device 10 may serve as ground (e.g., conductive components, traces on printed circuits, etc.).

The conductive material in structures 200 may also form one or more proximity sensor capacitor electrodes. With one suitable arrangement, structures 200 may include conductive layers 202 on dielectric carrier 204. Layers 202 may include parallel patterned conductive layers such as one or more flexible printed circuit metal layers and/or one or more patterned metal layers on the surface of carrier 204. As an example, layers 202 may include at least first and second parallel layers of patterned conductive material.

In configurations for layers 202 that include first and second parallel layers, the first layer may be formed on the surface of dielectric carrier 204. For example, the first conductive layer may be formed from a patterned metal coating that is formed directly on the surface of a plastic carrier. The second conductive layer may be formed as part of a substrate such as a flexible printed circuit (as an example). A layer of adhesive may be used in mounting the flexible printed circuit to dielectric carrier 204 on top of the first conductive layer formed from the patterned metal coating on the surface of dielectric carrier 204. In this configuration, portions of the flexible printed circuit and the layer of adhesive may be interposed between the parallel first and second conductive layers.

An antenna feed may have terminals that are coupled to one of the parallel conductive layers. At frequencies associated with antenna signals, the first and second layers may be effectively shorted to each other and may form an antenna resonating element. Proximity sensor circuitry such as capacitive proximity sensor circuitry may have terminals coupled respectively to the first and second layers. At frequencies that are below the antenna signal frequencies, the first and second layers may serve as first and second proximity sensor capacitor electrodes (e.g., an inwardly directed electrode and an outwardly directed electrode).

Structures 200 may be formed by using laser direct structuring (LDS) techniques to form patterned metal traces on dielectric carrier 204 and by laminating a patterned flex circuit layer to the outer surface of carrier 204 using adhesive. With laser direct structuring techniques, a metal complex or other materials may be incorporated into the plastic material that forms carrier 204 to ensure that carrier 204 can be activated by light exposure. Upon exposure to laser light in particular areas, the surface of carrier 204 becomes sensitized for subsequent metal growth. During metal growth operations following selective surface activation with laser light, metal will grow only in the activated areas exposed to the laser light.

By using laser direct structuring to pattern metal onto the surface of carrier 204, carrier 204 may incorporate potentially complex shapes. As an example, carrier 204 may include recessed features such as notch (bend) 206 to accommodate bent portion 58' of antenna window 58. As shown in FIG. 3, bent portion 58' of antenna window 58 may protrude inwardly from the exterior surface of antenna window 58 and may form a ledge that is interposed between a portion of display cover layer 60 and the notched portion of structures 200. Portions of the first layer (e.g., the laser direct structuring traces) and/or portions of the second layer (e.g., the flexible printed circuit) may be mounted on carrier 204 over some or all of notch 206, as illustrated by layer 202 on notch 206 in FIG. 3.

If desired, components may be mounted on the flex circuit in conductive layers 202 of structures 200. These components may include, for example, filter circuitry, impedance matching circuitry, resistors, capacitors, inductors, switches, and other electronic components. Conductive layers 202 may also include conductive traces for forming antenna resonating element patterns, transmission lines, and proximity sensor electrode patterns (as examples).

The first and second conductive layers may form electrodes for a proximity sensor that are also used as an antenna resonating element. The electrodes in layers 202 may be electrically isolated from each other.

If desired, conductive connections may, in certain locations, be formed between a signal conductor on one layers in layers 202 and an electrode on another layer in layers 202. Solder or other conductive materials (e.g., anisotropic conductive film, etc.) may be used in forming this type of connection. For example, a via that is filled with solder may be used to route signals from a signal path on one layer to a portion of a patterned electrode on another layer.

The electrode formed from the first layer of patterned conductive structures 202 may face outwards (e.g., in direction 300 for the portion located under window 58) and the electrode formed from the second patterned conductive layer may face inwards into housing 12 in direction 302 (as an example). Electromagnetic fields associated with conductive layers 202 may also pass through inactive portion 54 of display cover layer 60.

The two layers of patterned conductive material (electrodes) in layers 202 may be electrically isolated from each other by interposed dielectric to form a parallel plate capacitor. At frequencies below about 1 MHz, the parallel plate capacitor may have a relatively high impedance (e.g., forming a DC open circuit), so that the patterned layers may serve as independent first and second proximity sensor capacitor electrodes. At frequencies above 1 MHz (e.g., at frequencies above 100 MHz or above 1 GHz), the impedance of the parallel plate capacitor is low, so the patterned conductive layers may be effectively shorted together. This allows both of the layers to operate together as a unitary patterned conductor in an antenna resonating element.

During operation of the antenna formed from structures 200, radio-frequency antenna signals can be conveyed through dielectric window 58. Radio-frequency antenna signals associated with structures 200 may also be conveyed through a display cover member such as cover layer 60. Display cover layer 60 may be formed from one or more clear layers of glass, plastic, or other materials.

Display 50 may have an active region such as region 56 in which cover layer 60 has underlying conductive structure such as display panel module 64. The structures in display panel 64 such as touch sensor electrodes and active display pixel circuitry may be conductive and may therefore attenuate radio-frequency signals. In region 54, however, display 50 may be inactive (i.e., panel 64 may be absent). An opaque layer such as plastic or ink 62 may be formed on the underside of transparent cover glass 60 in region 54 to block the antenna resonating element from view by a user of device 10. Opaque material 62 and the dielectric material of cover layer 60 in region 54 may be sufficiently transparent to radio-frequency signals that radio-frequency signals can be conveyed through these structures in directions 70.

Device 10 may include one or more internal electrical components such as components 23. Components 23 may include storage and processing circuitry such as microprocessors, digital signal processors, application specific integrated circuits, memory chips, and other control circuitry. Components 23 may be mounted on one or more substrates such as substrate 79 (e.g., rigid printed circuit boards such as boards formed from fiberglass-filled epoxy, flexible printed circuits, molded plastic substrates, etc.). Components 23 may include input-output circuitry such as sensor circuitry (e.g., capacitive proximity sensor circuitry), wireless circuitry such as radio-frequency transceiver circuitry (e.g., circuitry for cellular telephone communications, wireless local area network communications, satellite navigation system communications, near field communications, and other wireless communications), amplifier circuitry, and other circuits. Connectors such as connector 81 may be used in interconnecting circuitry 23 to communications paths (e.g., transmission line 44 of FIG. 3).

Figure 4:
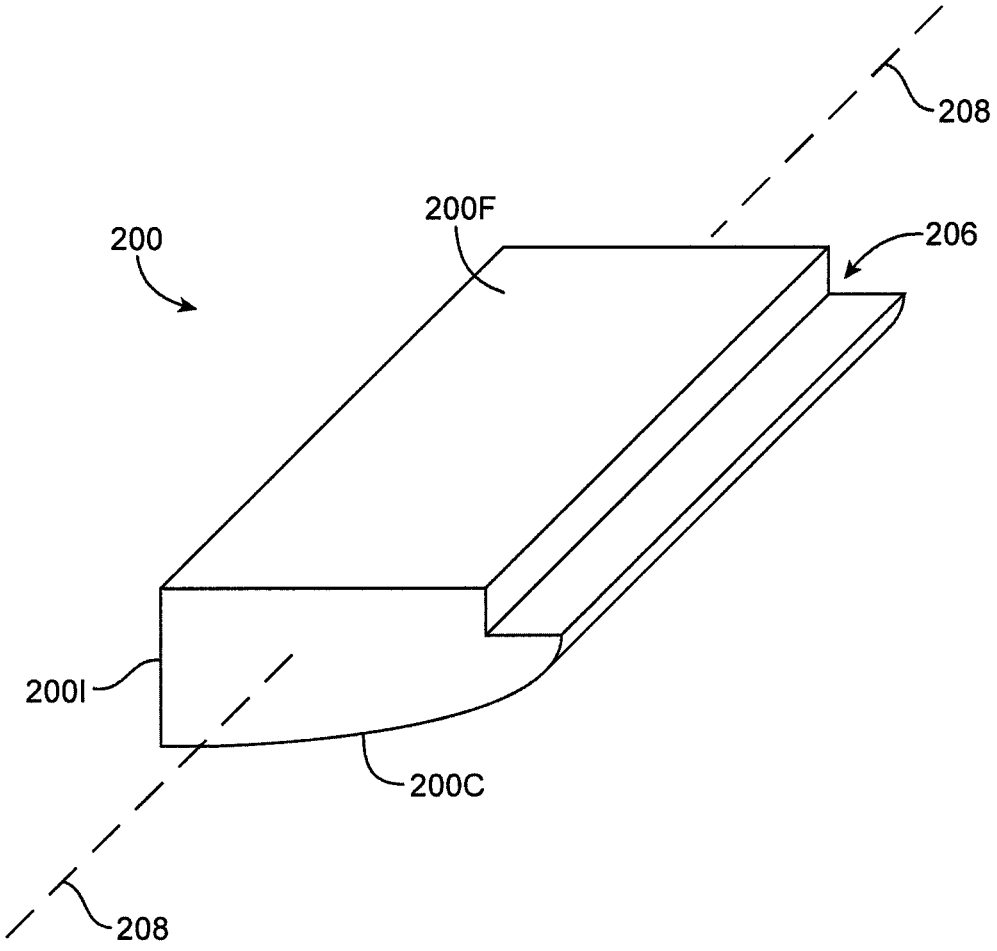
FIG. 4 is a perspective view of an illustrative dielectric carrier for an integrated antenna and proximity sensor in an electronic device in accordance with an embodiment of the present invention.

A perspective view of structures 200 in an illustrative configuration in which structures 200 have been provided with a notch such as notch 206 is shown in FIG. 4. As shown in FIG. 4, structures 200 may have an upper planar surface such as surface 200F and a curved outer surface such as surface 200E. Structures 200 may also have an interior surface such as surface 200I. To accommodate housing structures such as antenna window protrusion 58' of FIG. 3, structures 200 may have a recessed feature such as notch 206 or other structures that exhibit a bend. As shown in FIG. 3, structures 200 may have an elongated shape that runs parallel to longitudinal axis 208. Notch 206 may run along the outer edge of structures 200 parallel to axis 208 and parallel to the edge of housing 12 and antenna window protrusion 58'. The configuration for structures 200 in which notch 206 runs parallel to the length of structures 200 is merely illustrative. Other shapes and sizes may be used for structures 200 if desired.

Figure 5:
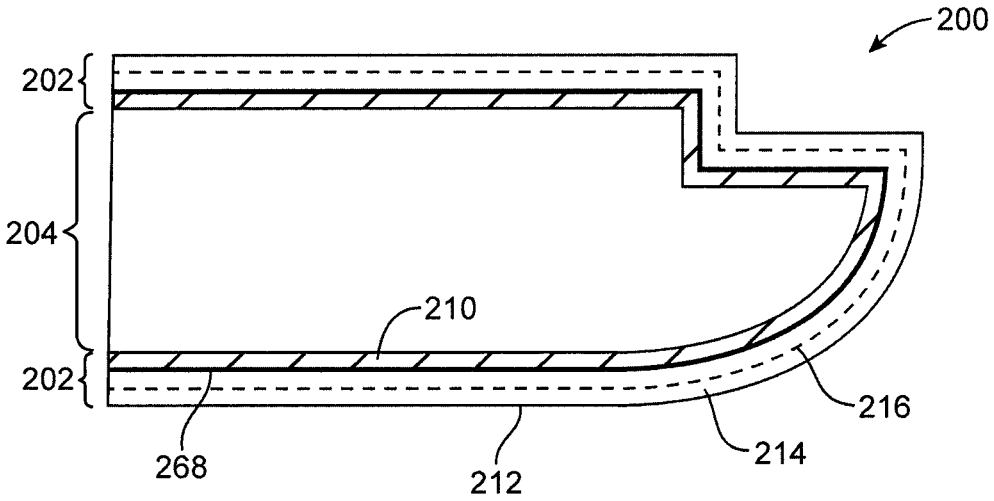
FIG. 5 is a cross-sectional side view of an electronic component formed from conductive traces on a dielectric carrier and conductive traces on a flexible printed circuit that is attached to the dielectric carrier in accordance with an embodiment of the present invention.

As shown in the cross-sectional side view of FIG. 5, conductive layers 202 may be formed on the exterior surface of structures 200. Conductive layers 202 may include a lower conductive layer such as layer 210 and an upper conductive layer such as layer 216. Layer 210 may be formed from a patterned metal coating (metal traces) formed directly on the exterior surface of dielectric support structure 204. Layer 216 may, as an example, be formed from a layer of patterned metal (metal traces) formed within a substrate such as substrate 214. Substrate 214 may be, for example, a sheet of polyimide or other polymer layer that forms a substrate for a printed circuit (i.e., flexible printed circuit 212). Substrate 214 may be attached to the surface of layer 210 using adhesive 268.

Metal layer 210 may be deposited using physical vapor deposition and subsequent patterning (e.g., etching or machining), may be deposited using a molded interconnect device (MID) technique in which multiple shots of plastic are formed in a mold and subsequently coated with metal that is selectively attracted to one of the shots of plastic, or may be deposited using laser direct structuring (LDS) techniques. Laser direct structuring approaches involve applying light to the surface of support 204 in a desired pattern to selectively activate a particular area on support 204 for subsequent metal deposition (e.g., electroplating). Support 204 may, if desired, be formed from a plastic that includes a metal complex to promote light activation.

Conductive layer 216 in flexible printed circuit 212 may be patterned using photolithography, screen printing, pad printing, or other suitable patterning techniques. Flexible printed circuit 212 may be attached to the surface of support structure 204 using adhesive 268 or other attachment mechanisms. Use of a flexible printed circuit to carry layer 216 allows layer 216 to conform to non-planar surface features such as notch 206, if desired. In configurations in which recessed features such a notch 206 contain shape bends, it may sometimes be desirable to cover the recessed features only with patterned coating layer 210 (which can form a conformal coating layer on the recessed features) and not with flexible printed circuit 214.

Figure 6:
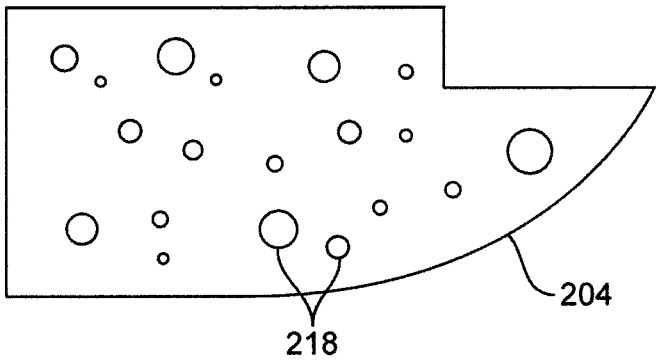
FIG. 6 is a cross-sectional side view of an illustrative carrier for antenna and proximity sensor structures in accordance with an embodiment of the present invention.

Dielectric structure 204 may serve as a support structure for layers 202 in structures 200. Structure 204 may be formed from glass, ceramic, plastic, or other dielectric material. To reduce dielectric losses during antenna operation, structure 204 may include lower-dielectric constant structures such as embedded structures 218 of FIG. 6. Structures 218 may have a dielectric constant that is lower than that of the main material used in forming structure 204. For example, structures 218 may be formed from hollow beads, may be formed from foam beads, may be formed from solid beads of material that have a dielectric constant lower than that of the primary material in structure 204, or may be formed from voids (e.g., gas-filled bubbles) or other structures that help lower the effective dielectric constant of structure 204.

Figure 7:
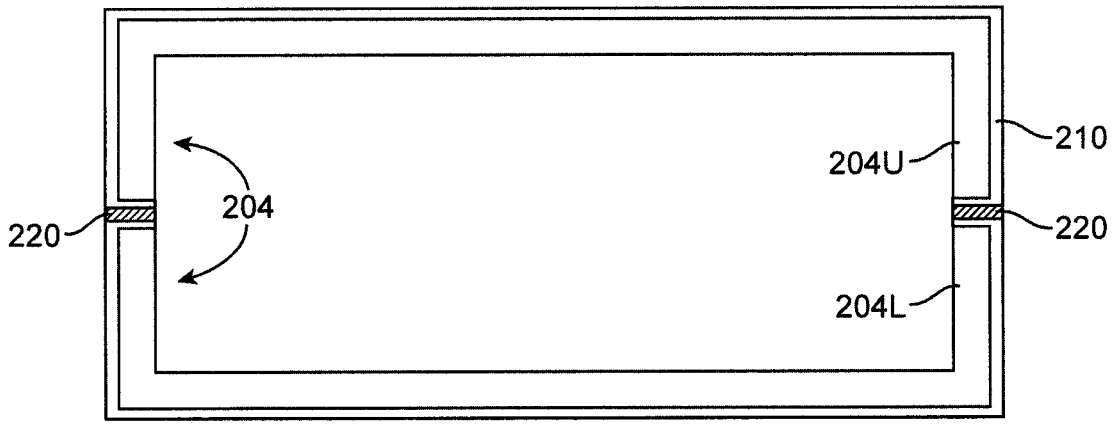
FIG. 7 is a cross-sectional view of an illustrative hollow dielectric carrier formed from two parts that have been soldered together by soldering together metal traces on the parts in accordance with an embodiment of the present invention.

If desired, structure 204 may be hollow to reduce the effective dielectric constant of structure 204. This type of configuration is shown in FIG. 7. As shown in the illustrative configuration of FIG. 7, structure 204 may be formed from mating portions (e.g., mating half cavities) such as upper portion 204U and lower portion 204L. Solder 220 may be used to join portions 204U and 204L (e.g., by connecting opposing portions of conductive layer 210 along the edges of portions 204U and 204L).

Figure 8:
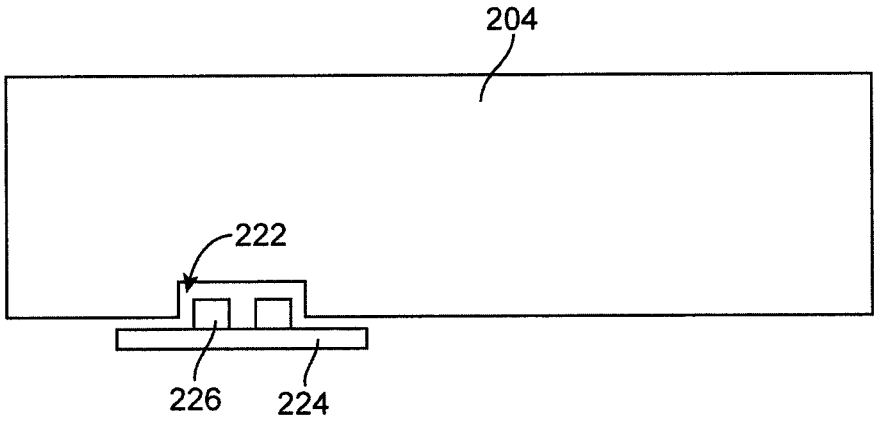
FIG. 8 is a side view of an illustrative dielectric carrier showing how the carrier may have a recess to accommodate components mounted on a substrate such as a flexible printed circuit in accordance with an embodiment of the present invention.

As shown in FIG. 8, structure 204 may, if desired, include a surface portion such as recessed portion 222. Recessed portion 222 may be a depression in the surface of structure 204 such as a notch, recess, groove, hole, or other feature that is configured to accommodate protruding components such as components 226 on substrate 224. Components 226 may be, for example, components associated with an antenna or proximity sensor circuit such as impedance matching circuitry, filter circuitry, etc. Substrate 224 may be a flexible printed circuit substrate, a rigid printed circuit substrate, or other suitable dielectric substrate. For example, substrate 224 may be formed using flexible printed circuit 212 of FIG. 5 and components 226 may be coupled to conductive layer 216 of printed circuit 212.

Figure 9:
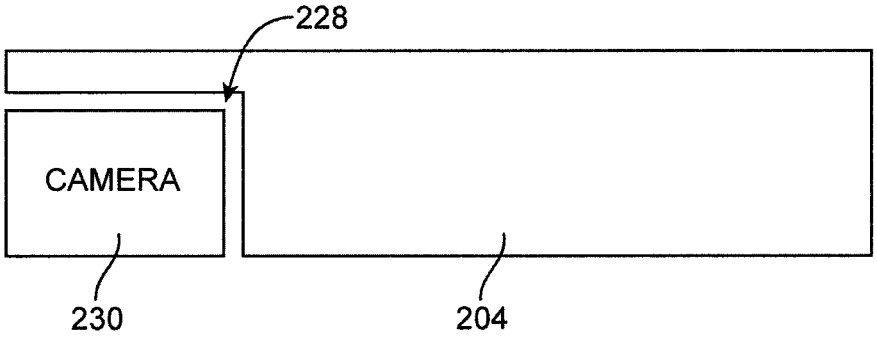
FIG. 9 is a side view of an illustrative dielectric carrier showing how the carrier may have a recess for accommodating electronic components such as a camera when mounting the carrier within an electronic device housing in accordance with an embodiment of the present invention.

As shown in FIG. 9, structure 204 may have a recess or other feature such as recess 228 of FIG. 9 to accommodate internal electronic components such as camera 230 or other devices in housing 12 of device 10.

Figure 10:
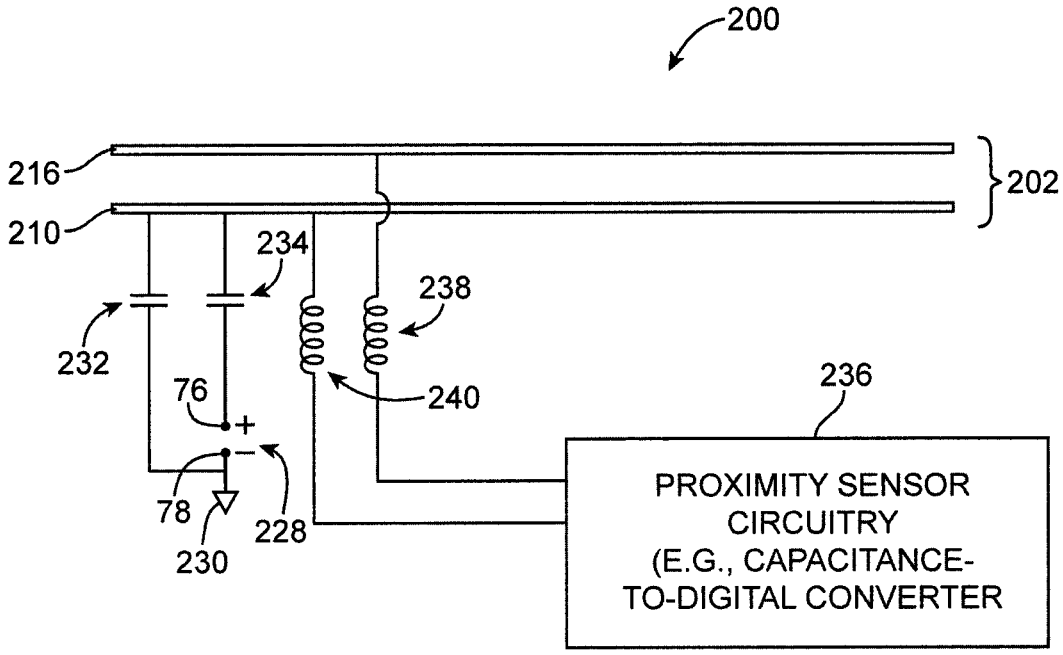
FIG. 10 is a diagram showing how an integrated antenna and proximity sensor structure may be formed from parallel layers of conductive material and may be coupled to an antenna feed and proximity sensor circuitry in accordance with an embodiment of the present invention.

FIG. 10 is a side view of a portion of structures 200 showing how conductive layers 202 in structures 200 may be coupled to antenna circuitry and proximity sensor circuitry. As shown in FIG. 10, structures 200 may terminals such as positive antenna feed terminal 76 and ground antenna feed terminal 78 that form an antenna feed for structures 200 such as antenna feed 228. Antenna feed 228 may be coupled to positive and ground conductors in transmission line 44 (FIG. 3). Transmission line 44 may, in turn, be coupled to radio-frequency transceiver circuitry (see, e.g., components 23 of FIG. 3) to support wireless communications. Terminal 78 may be coupled to ground 230. Circuitry such as capacitors 232 and 234 may be used to couple feed 228 to structures 202. Capacitor 232 may be coupled between ground 230 (feed terminal 78) and layer 210. Capacitor 234 may be coupled between feed terminal 76 and layer 210.

At high frequencies (i.e., a signal frequencies associated with antenna operation such as frequencies above 100 MHz), capacitors 232 and 234 may form short circuits that couple feed 228 to layer 210 in layers 202. A distributed capacitance may be formed between layers 210 and 216 (which serve as respective electrode plates in a parallel-plate capacitor). At antenna signal frequencies, layers 210 and 216 may be effectively shorted together and therefore may both participate in forming an antenna for device 10. At lower frequencies (i.e., frequencies associated with gathering capacitive proximity sensor signals), capacitors 232 and 234 may help prevent proximity sensor signals and other signals that could potentially interfere with the wireless transceiver circuitry of device 10 from reaching feed 228.

Proximity sensor circuitry 236 may include a capacitance-to-digital converter and other circuitry for gathering proximity sensor signals from structures 202. Proximity sensor circuitry 236 may have a pair of terminals coupled to low pass circuitry such as inductors 238 and 240. Layer 216 may be coupled to circuitry 236 via inductor 238. Layer 210 may be coupled to circuitry 236 via inductor 240. Inductors 238 and 240 may be configured to pass signals associated with operating a capacitive proximity sensor (circuitry 236) while blocking radio-frequency antenna signals that could interfere with proximity sensor circuitry 236.

The capacitance values for capacitors 232 and 234 are preferably of sufficient size to ensure that the impedance of these capacitors is low and does not disrupt antenna operation at frequencies associated with wireless signals in device 10. For example, if path 44 (FIG. 3) is being used to handle signals at frequencies of 100 MHz or more (e.g., cellular telephone signals, wireless local area network signals, etc.), the capacitance values of capacitors 232 and 234 may be 10 pF or more, 100 pF or more (e.g., 100 s of pF), or may have other suitable sizes that ensure that transmitted and received antenna signals are not blocked. At lower frequencies, the impedance of capacitors 232 and 234 is preferably sufficiently large to prevent interference from reaching the antenna resonating element formed from structures 200.

Proximity sensor circuitry 236 may be coupled to layers 202 in structures 200 through inductors 238 and 240. For example, proximity sensor circuitry such as capacitance-to-digital converter circuitry or other control circuitry may be used to make capacitance measurements using one or more capacitor electrodes formed from patterned conductive layers 210 and 216 of structures 200. Layer 216 may form a capacitive proximity sensor electrode. Layer 210 may form a shield layer for the proximity sensor. Inductors 238 and 240 may have impedance values (e.g., impedances of 100 s of nH) that prevent radio-frequency antenna signals (e.g., antenna signals at frequencies of 100 MHz or more) from reaching capacitance-to-digital converter or other circuitry in proximity sensor circuitry 236 while allowing AC proximity sensor signals (e.g., signals with frequencies below 1 MHz) to pass between structures 200 and proximity sensor circuitry 236.

Capacitors 232 and 234 form a high pass filter. By using high-pass circuitry, low frequency noise can be prevented from interfering with antenna operation for structures 200. Inductors 238 and 240 form a low-pass filter. By using low-pass circuitry, radio-frequency noise from antenna signals can be prevented from interfering with proximity sensor operation for structures 200. If desired, other types of high-pass and low-pass filters may be interposed between structures 200 and the radio-frequency transceiver circuitry and proximity sensor circuitry that is associated with structures 200. The arrangement of FIG. 10 is merely illustrative.

Figure 11:
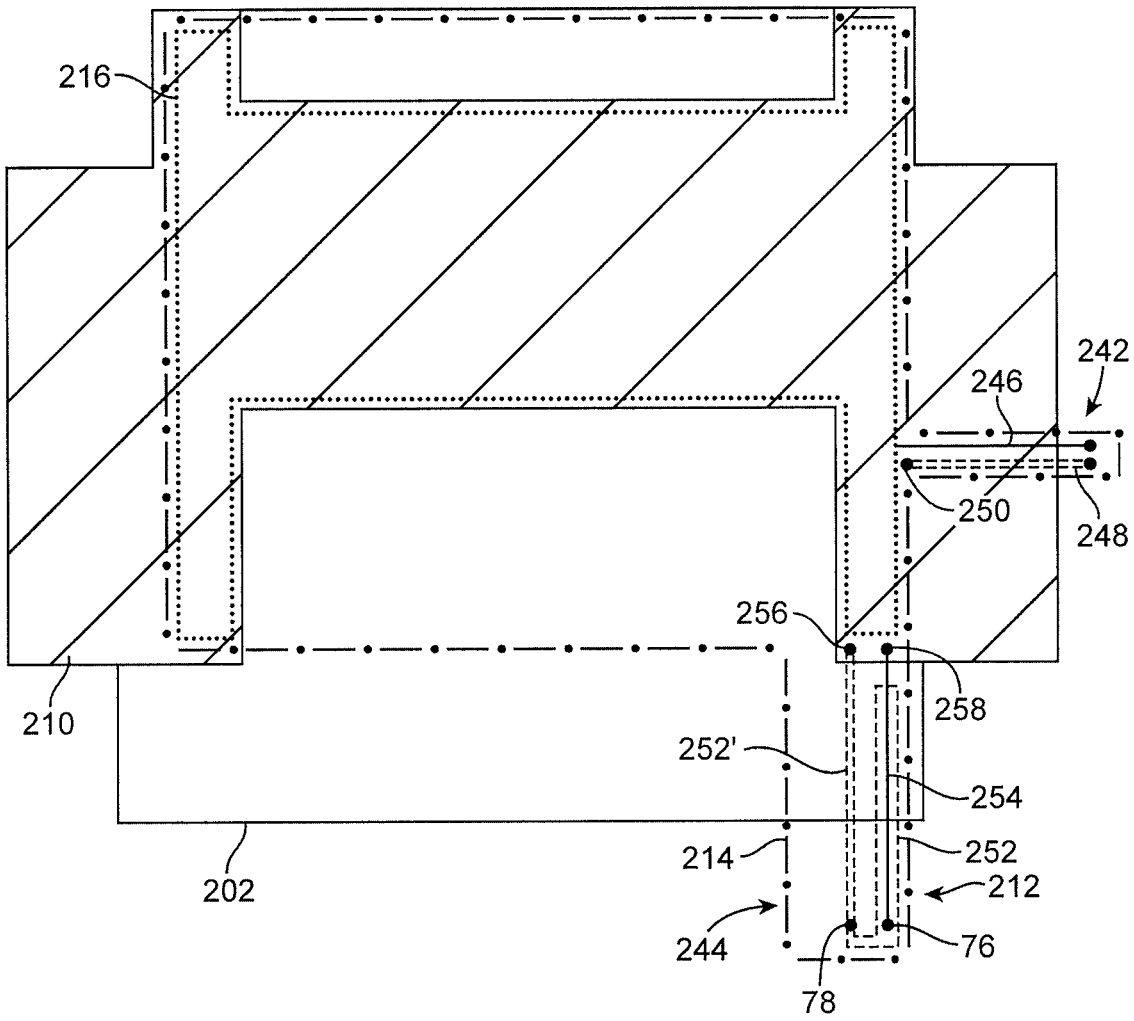
FIG. 11 shows illustrative patterns that may be used for conductive layers in an integrated antenna and proximity sensor structure of the type shown in FIG. 10 in accordance with an embodiment of the present invention.

FIG. 11 is a top view of illustrative conductive structures 202 in an unassembled (unfolded) state. In practice, the layers of FIG. 11 are formed around support structure 204. Patterned conductor layouts other than the layout of FIG. 11 may be used in structures 200 if desired. The example of FIG. 11 is merely illustrative.

In the example of FIG. 11, conductive layer 210, which is denoted by cross-hatching, lies on the bottom of layers 202 (i.e., layers 202 are being viewed from the exterior of structure 200). Flexible printed circuit 212 includes substrate 214 and conductive traces 216. Substrate 214 may have a shape given by dash-and-dotted outline 214 in FIG. 11. Metal traces 216 may have the shape given by dotted line 216 in FIG. 11. Flexible printed circuit 214 may have a proximity sensor tail such as tail 242 and an antenna feed tail such as tail 244.

Proximity sensor tail 242 may have a first signal path such as path 246 that is coupled to layer 216 and may have a second signal path such as signal path 248 that is coupled to layer 210 using via connection 250.

Antenna feed tail 244 may have a microstrip transmission line formed from conductive line 254 and underlying portions of ground path structure 252 (e.g., an underlying metal layer on flexible printed circuit 212). Terminal 76 may be coupled to layer 210 using path 254 and via 258. Terminal 78 may be coupled to layer 210 using path portion 252' of structures 252 and via 256. Vias such as vias 256, 258, and 250 may include solder bumps or other structures for forming electrical connections with layer 210.

Figure 12:
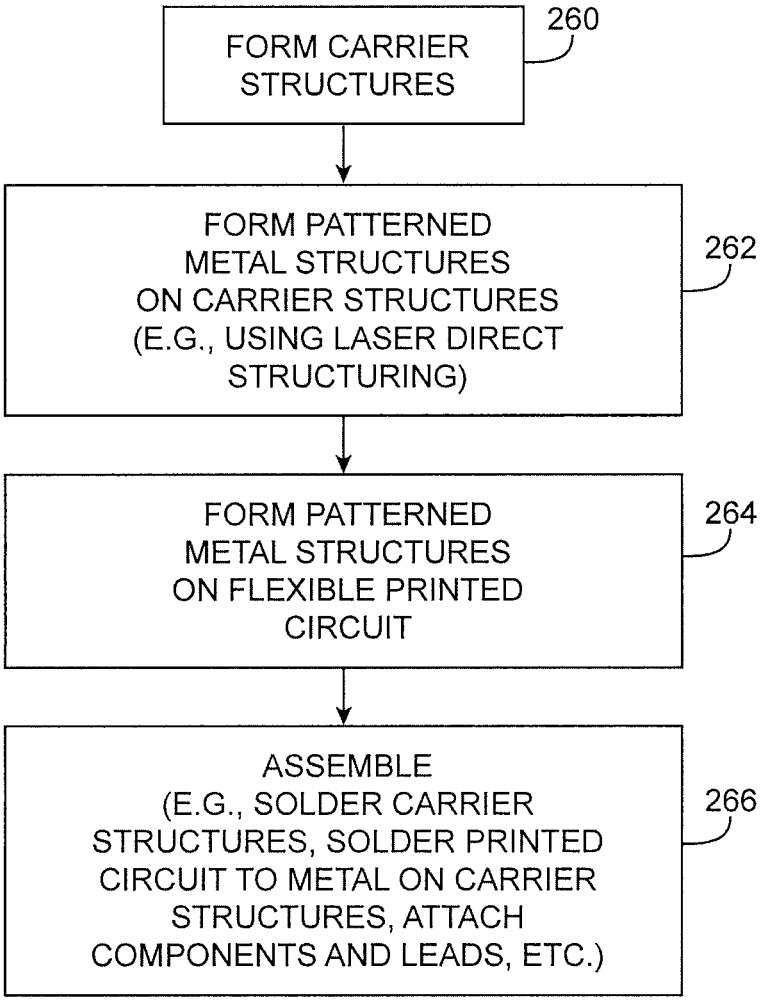
FIG. 12 is a flow chart of illustrative steps in forming integrated antenna and proximity sensor structures in accordance with an embodiment of the present invention.

A flow chart of illustrative steps involved in forming structures such as structures 200 in device 10 is shown in FIG. 12.

At step 260, carrier structures such as structure 204 may be formed. For example, structure 204 may be formed using plastic injection molding, machining, and other fabrication techniques. If desired, structure 204 may be formed from a dielectric such as glass or ceramic. Structure 204 may include recesses and other bent features that help accommodate device structures such as antenna window structure 58, housing structure 12, cover layer 60, and other structures in device 10. Structure 204 may, for example, have an elongated shape characterized by a longitudinal axis such as axis 208 of FIG. 4 and may have a recessed portion such as notch 206 that runs parallel to longitudinal axis 208 and the edge of structure 204.

At step 262, patterned conductive layer 210 may be formed. As an example, a laser direct structuring tool may be used to apply laser light to the external surface of structure 204 to activate a desired surface area for subsequent metal deposition. Following activation, structure 204 may be exposed to metal deposition material (e.g., an electroplating bath or other metal source) to grow patterned metal layer 210.

At step 264, one or more patterned conductive layers such as patterned metal layer 216 may be formed on flexible printed circuit 212 (e.g., using photolithography, screen printing, or other printed circuit patterning techniques).

At step 266, structures 200 may be assembled and mounted in device 10. For example, flexible printed circuit 212 may, if desired, be attached to the surface of layer 210 using adhesive (see, e.g., adhesive layer 268 in FIG. 5). Solder, conductive adhesive, or other suitable materials may be used in coupling the traces of flexible printed circuit 212 to layer 210 and/or other conductive structures (e.g., transmission line structure 44, proximity sensor circuitry 236, components such as components 226 of FIG. 8 and components 23 of FIG. 3, etc.). Structures 200 may then be mounted in housing 12 of device 10 under antenna window 58 and portion 54 of display cover layer 60, as shown in FIG. 3.

The foregoing is merely illustrative of the principles of this invention and various modifications can be made by those skilled in the art without departing from the scope and spirit of the invention.

What is claimed is:

1. An electronic device, comprising:

a display cover layer;

antenna and proximity sensor structures that include parallel first and second conductive layers on a dielectric support structure, wherein the dielectric support structure has a surface and a notch;

an antenna window structure that has a portion that extends into the notch between the display cover layer and the antenna and proximity sensor structures, wherein the first conductive layer comprises metal on the surface of the dielectric support structure; and a flexible printed circuit substrate, wherein the second conductive layer comprises metal on the flexible printed circuit substrate.

2. The electronic device defined in claim 1 further comprising a capacitive proximity sensor circuit that is coupled to the first and second conductive layers.

3. The electronic device defined in claim 2 further comprising:

a high-pass circuit; and an antenna feed that is coupled to the antenna and proximity sensor structures by the high-pass circuit.

4. The electronic device defined in claim 3 wherein the display cover layer comprises a planar glass member, the electronic device further comprising a layer of opaque material interposed between a portion of the planar glass member and the antenna and proximity sensor structures.

5. The electronic device defined in claim 3 wherein the high-pass circuit comprises first and second capacitors, wherein the antenna feed has a first antenna feed terminal that is coupled to the first conductive layer by the first capacitor, and wherein the antenna feed has a second antenna feed terminal that is coupled to the first conductive layer by the second capacitor.

6. The electronic device defined in claim 1 further comprising:

a capacitive proximity sensor circuit that is coupled to the first and second conductive layers by a low pass circuit;

an antenna feed having a first terminal that is coupled to the first conductive layer and having a second terminal that is coupled to the first conductive layer; and a conductive housing in which the antenna window structure is mounted.

7. An electronic device, comprising:

antenna and proximity sensor structures that include parallel first and second conductive layers on a dielectric support structure, wherein the dielectric support structure has a notch, at least some of the first conductive layer overlaps the notch, the antenna and proximity sensor structures include an antenna feed configured to receive antenna signals, the dielectric support structure has a surface, and the first conductive layer comprises metal on the surface;

capacitive proximity sensor circuitry coupled to the antenna and proximity sensor structures;

a flexible printed circuit substrate, wherein the second conductive layer comprises metal on the flexible printed circuit substrate; and an antenna window structure having a portion that extends into the notch.

8. The electronic device defined in claim 7 further comprising a high pass circuit coupled between the antenna feed and the first conductive layer.

9. The electronic device defined in claim 8 further comprising a low pass circuit coupled between the capacitive proximity sensor circuitry and the first and second conductive layers.

10. The electronic device defined in claim 7 further comprising:

a metal housing in which the antenna window structure is mounted.

11. The electronic device defined in claim 7 wherein the dielectric support structure is configured to be hollow.

12. The electronic device defined in claim 10 further comprising a camera, wherein the dielectric support structure has a recessed portion that is configured to accommodate the camera.

* * * * *